US011286749B2

(12) United States Patent
Davies et al.

(10) Patent No.: US 11,286,749 B2
(45) Date of Patent: Mar. 29, 2022

(54) REMOTE-OPEN DEVICE FOR WELL OPERATION

(71) Applicant: Halliburton Energy Services, Inc., Houston, TX (US)

(72) Inventors: Katherine Ann Davies, Carnoustie (GB); Steven John Craik, Conroe, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 104 days.

(21) Appl. No.: 16/405,498

(22) Filed: May 7, 2019

(65) Prior Publication Data

US 2019/0360305 A1 Nov. 28, 2019

Related U.S. Application Data

(60) Provisional application No. 62/674,933, filed on May 22, 2018.

(51) Int. Cl.

| | |
|---|---|
| ***E21B 34/12*** | (2006.01) |
| ***E21B 34/14*** | (2006.01) |
| ***E21B 34/10*** | (2006.01) |

(52) U.S. Cl.

CPC ..... *E21B 34/12* (2013.01); *E21B 34/10* (2013.01); *E21B 34/14* (2013.01); *E21B 2200/06* (2020.05)

(58) Field of Classification Search

CPC ..... E21B 23/06; E21B 2200/06; E21B 34/10; E21B 34/14; E21B 23/004

See application file for complete search history.

(56) References Cited

U.S. PATENT DOCUMENTS 4,632,187 A * 12/1986 Deaton ..... E21B 34/10 166/323

5,609,178 A 3/1997 Hennig et al.

(Continued)

FOREIGN PATENT DOCUMENTS

| | | |
|---|---|---|
| EP | 2447466 | 5/2012 |
| EP | 2823135 | 1/2015 |

OTHER PUBLICATIONS

Application No. PCT/US2019/031418 , International Search Report and Written Opinion, dated Aug. 22, 2019, 12 pages.

(Continued)

*Primary Examiner* — Kipp C Wallace

(74) *Attorney, Agent, or Firm* — Kilpatrick Townsend & Stockton LLP

(57) ABSTRACT

An assembly includes a housing of a production tubing including one or more housing ports around a housing circumference of the housing. The assembly also includes a sleeve including one or more sleeve ports around a sleeve circumference of the sleeve. The sleeve is moveable between a closed configuration in which at least a portion of the sleeve is positionable to cover the housing ports of the production tubing and an open configuration in which the sleeve is positionable such that the sleeve ports provide fluid communication between the production tubing and an annulus in a wellbore. Further, the assembly includes a shoulder positioned at an uphole edge of the sleeve to apply an opening force to the sleeve to change the sleeve from the closed configuration to the open configuration.

17 Claims, 6 Drawing Sheets

(56) References Cited

U.S. PATENT DOCUMENTS

| | | | | |
|---|---|---|---|---|
| 7,870,908 | B2 * | 1/2011 | Mandrou | E21B 34/10 166/386 |
| 9,115,565 | B1 | 8/2015 | Richards et al. | |
| 2005/0230119 | A1 | 10/2005 | McGarian et al. | |
| 2009/0229828 | A1 * | 9/2009 | Ross | E21B 34/10 166/319 |
| 2011/0259595 | A1 | 10/2011 | Nguy et al. | |
| 2012/0085542 | A1 | 4/2012 | Hayter et al. | |
| 2012/0199364 | A1 * | 8/2012 | Frosell | E21B 34/06 166/373 |
| 2013/0175095 | A1 | 7/2013 | Dewey et al. | |
| 2015/0218908 | A1 * | 8/2015 | Webber | E21B 34/10 166/374 |
| 2016/0201432 | A1 | 7/2016 | Holcomb et al. | |
| 2017/0114611 | A1 | 4/2017 | Ringgenberg | |
| 2019/0153819 | A1 * | 5/2019 | Fisher | E21B 34/108 |

OTHER PUBLICATIONS

CA. Application No. CA3,094,331 , Office Action, dated Nov. 2, 2021, 3 pages.
SG. Application No. SG11202007000W , Written Opinion, dated Feb. 4, 2022, 7 pages.

* cited by examiner

REMOTE-OPEN DEVICE FOR WELL OPERATION

CROSS-REFERENCE TO RELATED APPLICATION

This claims the benefit of and priority to U.S. Provisional Application Ser. No. 62/674,933, filed May 22, 2018 and titled "REMOTE-OPEN DEVICE FOR WELL OPERATION," the entire contents of which are hereby incorporated by this reference.

TECHNICAL FIELD

The present disclosure relates generally to operating a remote-open concentric fluid loss device for use in a wellbore environment. More specifically, though not exclusively, the present disclosure relates to remotely opening a downhole device by applying pressure cycles to tubing within the wellbore.

BACKGROUND

During wellbore operations, perforation of the wellbore may be conducted while a concentric fluid loss device is positioned within the wellbore. In some cases, the concentric fluid loss device includes a ball valve that can be opened to provide a communication path between the tubing and an annulus within the wellbore. Once perforation is completed, the concentric fluid loss device is opened.

Downhole devices, such as sleeves, can require manual intervention to control fluid flow between production tubing and the annulus within a wellbore. During perforation or other wellbore operations, debris can accumulate above a ball valve of a concentric fluid loss device in lower zone applications. In some cases, sufficient debris accumulates such that a rig must return to the well for remedial intervention and wellbore cleanout, and to operate the concentric fluid loss device manually.

DETAILED DESCRIPTION

Figure 1:
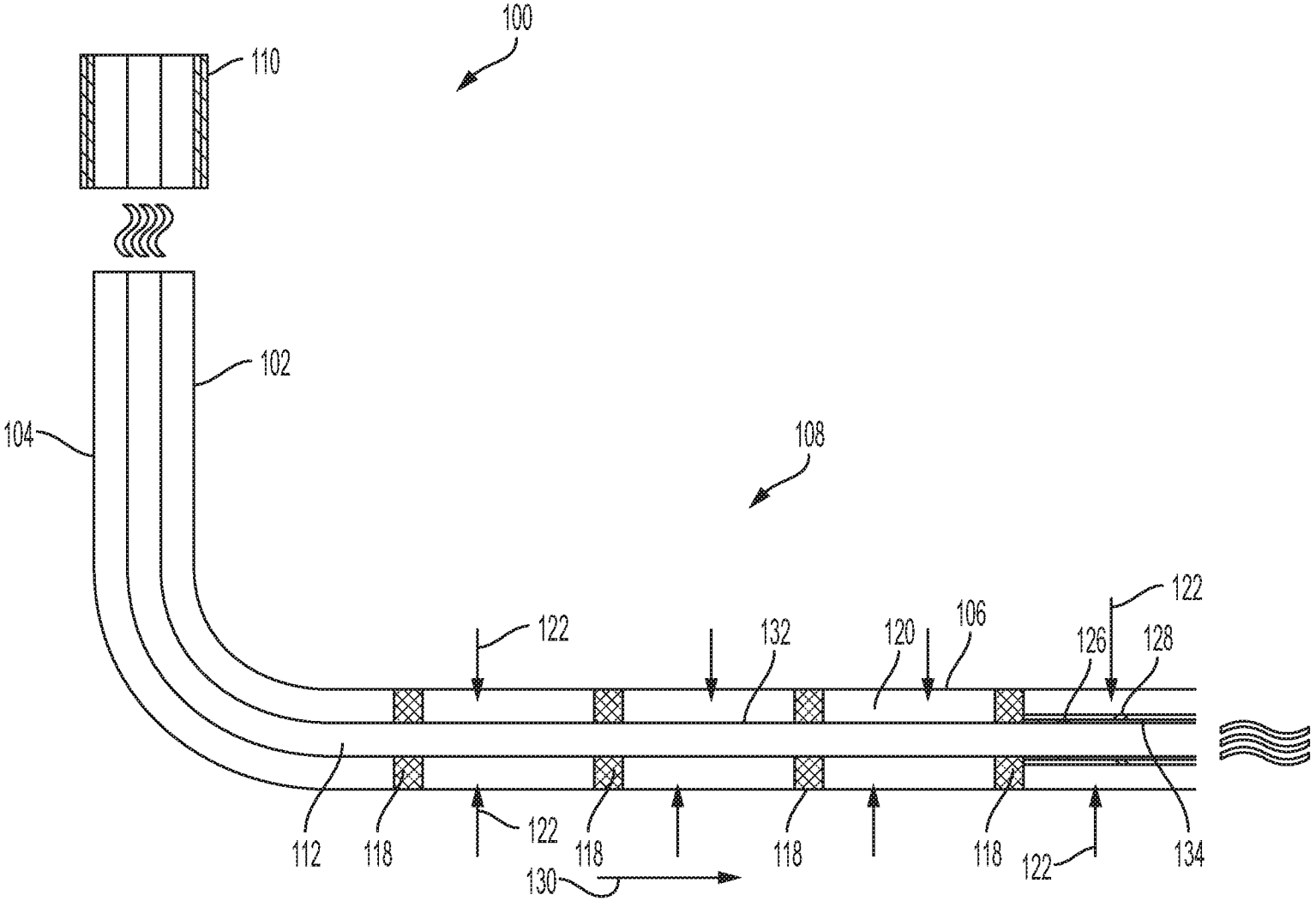
FIG. 1 is a cross-section schematic view of an example of the wellbore environment including a remote-open device according to some aspects of the present disclosure.

Certain aspects and features relate to a remote-open device for use in a wellbore environment. The remote-open device can be remotely opened by applying pressure cycles to the tubing within the well. The remote-open device can include a sleeve or other completion device that can be operated to provide a flow path between an inner area of a production tubing and an annulus of the wellbore.

Pressure cycles can be applied to the production tubing within the wellbore. After a predetermined number of pressure cycles are applied to the pressure-activated indexing device, the device can release and push open the sleeve device. When the remote-open device is in an open configuration, the sleeve can allow fluid communication between an interior of the production tubing and the annulus between the production tubing and a wall of the wellbore. A predetermined number of pressure cycles can be applied remotely to the tubing within the wellbore to transition the remote-open device into a closed configuration. Transitioning the remote-open device from an open configuration to a closed configuration can close the fluid communication path between the production tubing and the annulus.

The remote-open device can limit occurrences of manual intervention to operate downhole devices for controlling fluid communications in the wellbore (e.g., ports, sleeves, other fluid communication controllers, etc.). Reducing the number of manual interventions in a wellbore drilling process and operation can reduce the nonprofit times and improve overall system efficiency. Implementation of a remote-open tool can also avoid a potential high cost intervention by providing longer sump for debris accumulation. A longer sump can remove significant risk from operation and can allow the well to be begin a production and injection phase earlier due to providing greater confidence that debris will not be an issue if the valve is opened from a host vessel. The longer sump provides more room for debris accumulation without interference with the valve. This can negate the need for a rig to return the field for a remedial intervention involving additional wellbore cleanout and mechanical operation of a valve.

The remote-open device can have three modes of operation: pre-remote-open, remote-open, and post-remote-open. In a pre-remote-open configuration, the remote-open device can be manually manipulated open or closed. In a closed position, slots in a housing of the remote-open device can be covered on one or both sides by seals. In an open position, slots in a sleeve and the slots in the housing can line up, allowing communication between the tubing and the annulus of the wellbore. Manipulating the remote-open device can be performed by moving a profile on the shoulder uphole or downhole as appropriate.

The remote-open device can be transitioned from a pre-remote-open configuration to a remote-open configuration when a pre-determined number of pressure cycles are applied to the production tubing. Application of the predetermined number of pressure cycles to the system can result in the indexing of the system (e.g., similar to operation of a fluid loss isolation valve, or another type of valve). Upon the bleed down of the last pressure cycle, a latch can be released causing power springs to release. The force provided by the springs can push an uncoupling device to contact the shoulder of the remote-open device. Applying force to the shoulder of the remote-open device through forceful contact with the springs can cause the sleeve to be pushed in a direction that opens the remote-open device (e.g., aligning the slots in the housing and the slots in the mandrel). In some configurations, the uncoupling device can be a shearable component capable of transferring force to the sleeve.

In a post-remote-open configuration, a profile on the mandrel can be used to manually open and close the sleeve as necessary using the profile on the shoulder. For example, the sleeve can be controlled and operated manually by a slickline tool string 132.

FIG. 1 is a cross-section schematic view of an example of a wellbore environment 100 including a remote-open device 134 according to some aspects of the present disclosure. The wellbore environment 100 may include a wellbore 102 with a generally vertical section 104 that transitions into a generally horizontal section 106 extending through a subterranean earth formation 108. In an example, the vertical section 104 may extend in a downhole direction 130 from a portion of the wellbore 102 having a cemented in casing string 110. A tubular string, such as a production tubing 112, may be installed or extended into the wellbore 102.

One or more packers 118 may be installed around the production tubing 112 within the wellbore 102. The packer 118 may seal an annulus 120 located between the production tubing 112 and walls of the wellbore 102 to create multiple intervals within the wellbore 102 for fluid production. As a result, fluids 122 may be produced from multiple intervals or "pay zones" of the formation 108 through isolated portions of the annulus 120 between adjacent pairs of packers 118.

In addition, the wellbore environment 100 may include the remote-open device 134 that allows sleeve ports 126 to line up with housing ports 128 in order to allow communication between the production tubing 112 and annulus 120. The sleeve ports 126 and housing ports 128 can be opened or closed by the remote-open device 134, where the ports communicate fluids between the production tubing 112 and the annulus 120. The one or more packers 118 may be positioned both uphole and downhole from the remote-open device 134.

In one example, the remote-open device 134 can be opened downhole without manual intervention. The remote-open device 134 can be implemented with a fracturing pack, a gravel pack, a standalone screen, and in multizone applications. The remote-open device 134 can allow a perforating operation to be conducted while the remote-open device 134 is positioned within the wellbore 102 without the risk malfunctioning due to debris accumulation.

In some examples, as discussed below with respect to FIG. 4, the remote-open device 134 is a pressure-operated downhole device including an indexing mechanism that does not implement cams. The remote-open device 134 can be a pressure-activated indexing device including a sleeve that can be transitioned to an open configuration through the application of pressure cycles. In an example, the pressure cycles may release and push open the sleeve when the pressure cycles include a single shot, multiple shots, or a unique operation (e.g., open-on-demand). Coupling the indexing section of a device with remote-open capability (e.g., a fluid loss isolation barrier valve) with a sliding sleeve enables a communication between the tubing and annulus to be opened upon demand (e.g., after a predetermined number of pressure cycles).

Figure 2:
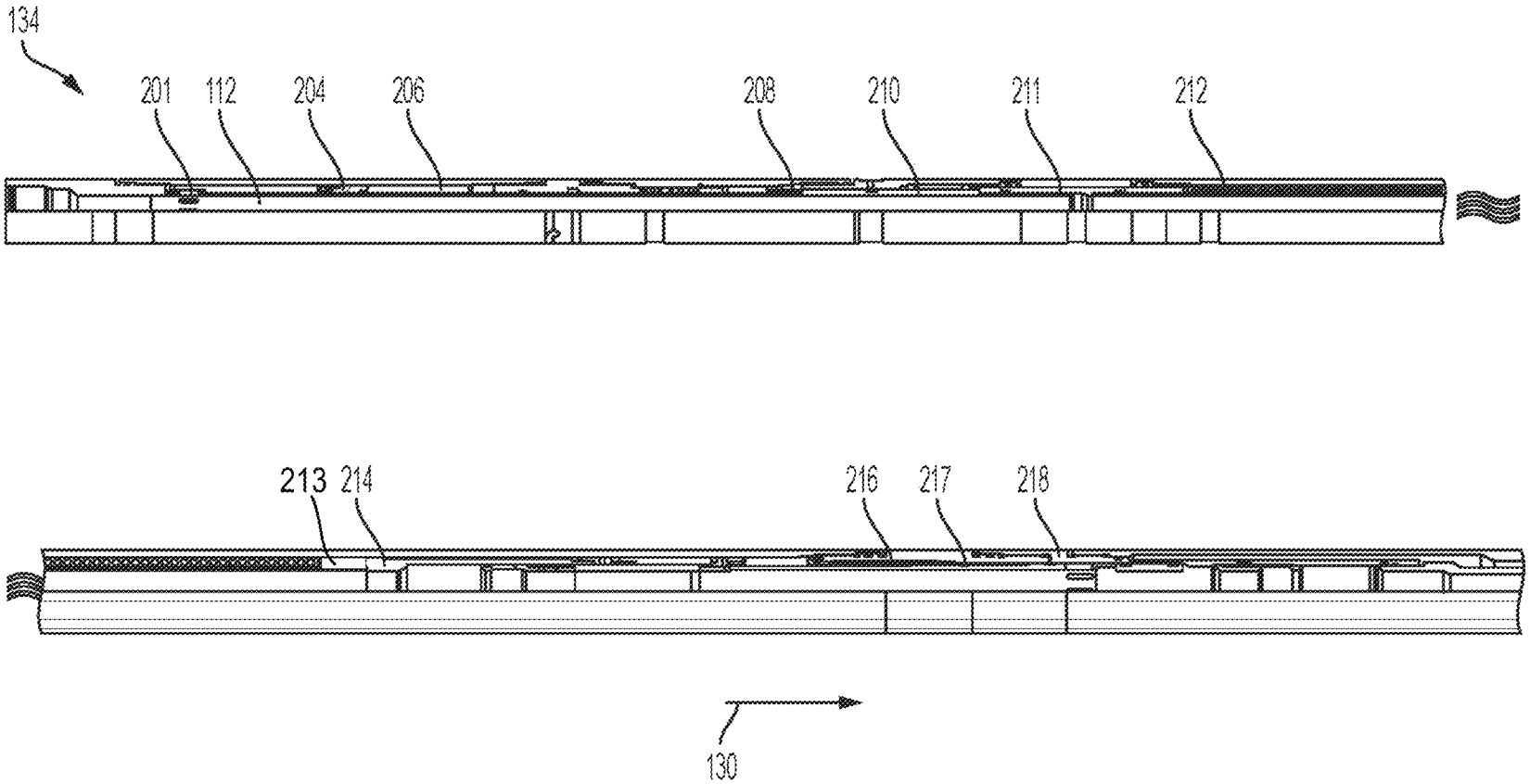
FIG. 2 is a sectional view of an example of the remote-open device of FIG. 1 according to some aspects of the present disclosure.

FIG. 2 is a sectional view of the remote-open device 134. The arrow shows the downhole direction 130 of the wellbore environment 100. The sectional view in FIG. 2 shows the remote-open device 134 in a closed configuration. By creating pressure cycles within the production tubing 112 using a pressure pump located at a surface of the wellbore environment 100, a floating piston 204 can be used to deliver hydraulic pressure cycles to fluid 206. When a pressure cycle is initiated in the production tubing 112, the pressure is transmitted to the floating piston 204 through one or more ports 201.

The fluid 206 can be compressed silicone oil and generates pressure in the downhole direction 130 against the pressure-activated indexing device 208. After a predetermined number of pressure cycles, the pressure-activated indexing device 208 de-supports a latch 210 releasing the power spring 212. The pressure-activated indexing device is further described below in FIGS. 5 and 6. The movement of a sleeve 216 is facilitated by the power spring 212 and a connection component 214, which cause the sleeve 216 to move with respect to the housing 218.

Figure 3:
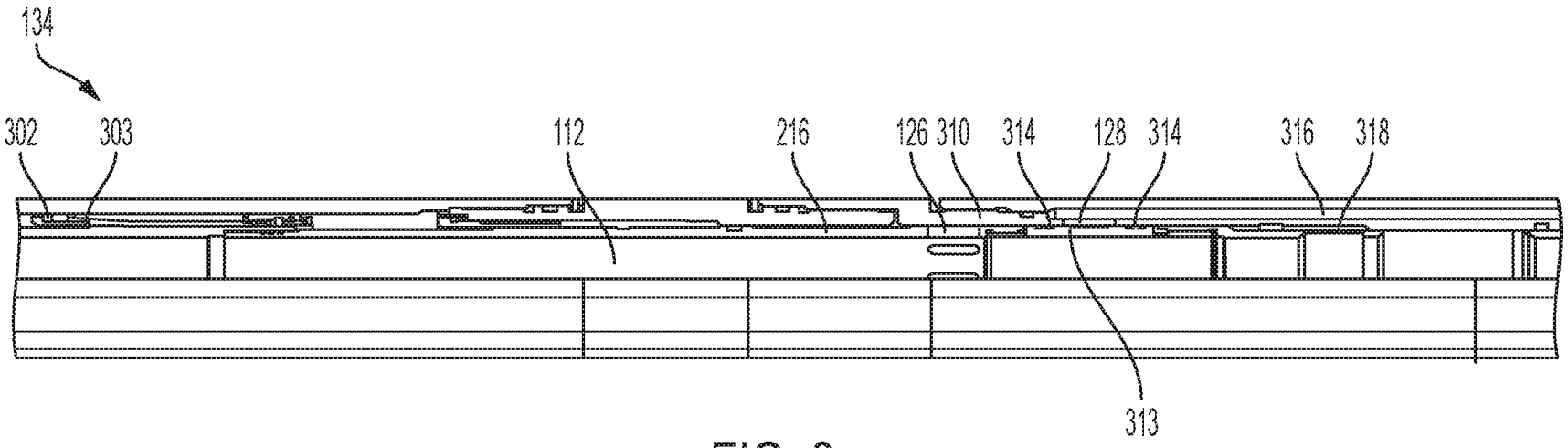
FIG. 3 is a sectional view of an example of a downhole section of the remote-open device of FIG. 1 in a closed configuration according to some aspects of the present disclosure.

FIG. 3 is a sectional view of an example of a downhole section of the remote-open device 134 in a closed configuration. In the closed configuration, an uncoupling device 302 is not in contact with a shoulder 303 positioned at the uphole edge of the sleeve 216 that interacts with the sleeve 216. The sleeve 216 contains one or more sleeve ports 126 around the circumference of the sleeve. The housing 218 contains one or more housing ports 128 around the circumference of the housing. In the closed configuration, the sleeve ports 126 line up with a solid section 310 of the housing 218, and housing ports 128 line up with a solid section of the sleeve 216. A fluid flow path 316 to the annulus 120 is sealed from communication with an interior 304 of the remote-open device 134 by a blocking portion 313 of the sleeve 216 and one or more O-rings 314 positionable uphole and downhole from the blocking portion 313. As a result, the production tubing 112 of the remote-open device 134 is not in fluid communication with the fluid flow path 316.

When the remote-open device 134 transitions into an open configuration, the connection component 214 moves downhole and engages the uncoupling device 302 to apply an uncoupling force. The uncoupling device 302 moves to engage the shoulder 303 applying an opening force, which allows the sleeve 216 to move. The shoulder 303 moves in the downhole direction 130 in response to the uncoupling force to move the sleeve 216 in the downhole direction 130. In some examples, a boost piston 213 can be used to generate additional opening force. The boost piston 213 is biased by pressure to move inner components, such as the sleeve 216 and the connection component 214, in a downhole direction from seals 211 and 217.

In some examples, the remote-open device 134 can transition from an open configuration to a closed configuration. A shifting tool can be used on a profile 318 of the sleeve 216 to manually move the sleeve into a closed configuration.

Figure 4:
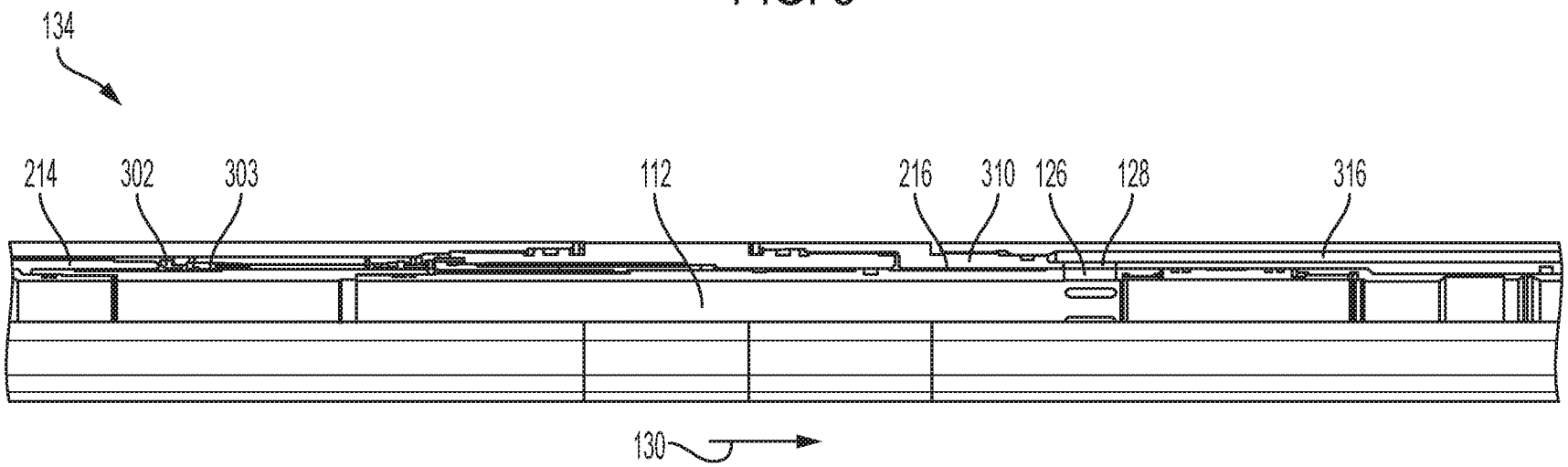
FIG. 4 is a sectional view of an example of the downhole section of the remote-open device of FIG. 1 in an open configuration according to some aspects of the present disclosure.

FIG. 4 is a sectional view of an example of the remote-open device 134 in an open configuration. A connection component 214 is pushed in the downhole direction 130 by the power springs 212 to engage the uncoupling device 302 to contact the shoulder 303 to move the sleeve 216 in the downhole direction 130. In some examples, a boost piston 213 can provide additional force. As a result of the sleeve 216 moving in the downhole direction 130, the sleeve ports 126 line up with the housing ports 128 allowing fluid communication between the interior 304 of the remote-open device 134 and the fluid flow path 316.

Figure 5:
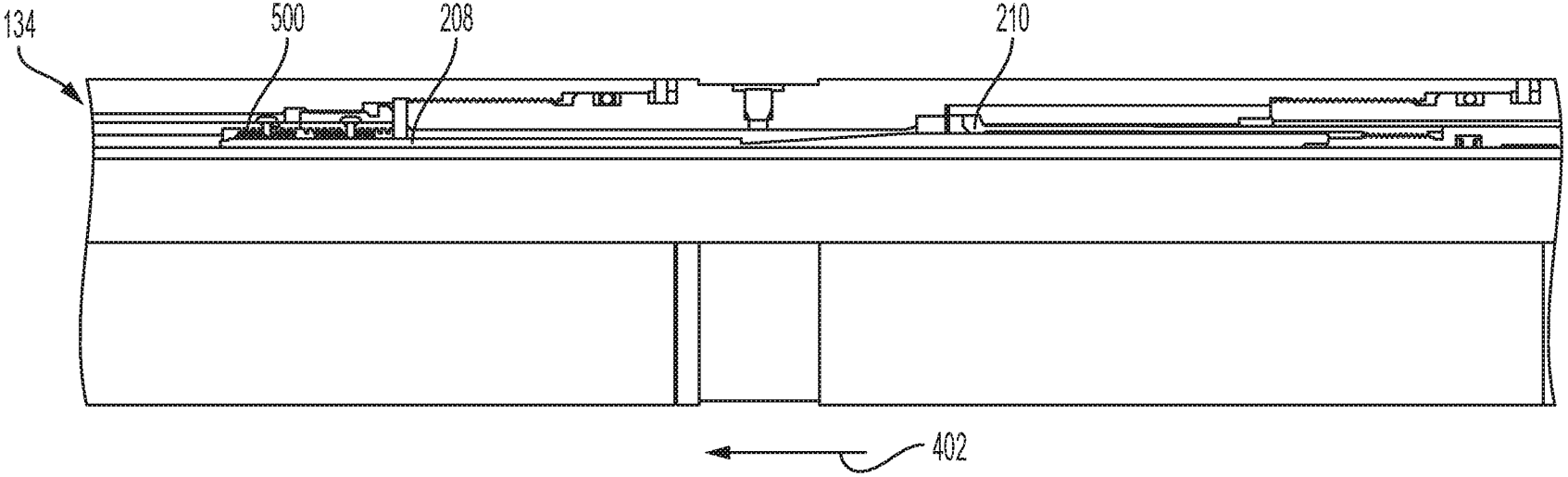
FIG. 5 is a sectional view of an example of a pressure-activated indexing device of the remote-open device of FIG. 1 in a closed configuration according to some aspects of the present disclosure.

FIG. 5 is a sectional view of an example of a pressure-activated indexing device 208 of the remote-open device 134 in a closed configuration according to some aspects of the present disclosure. In the closed configuration, the latch 210 is in a latched position and the pressure-activated indexing device 208 blocks the latch 210 to prevent movement of the latch 210 into an unlatched position. When pressure cycles are applied to the pressure-activated indexing device 208, the pressure-activated indexing device 208 allows movement of the latch 210 to an unlatched position.

In some examples, the pressure-activated indexing device 208 moves in an uphole direction 402 a predetermined distance based on the configuration of the pressure-activated indexing device 208. For example, the pressure-activated indexing device 208 is ratcheted along a ratchet system 500 in the uphole direction 402 at each pressure cycle supplied to the pressure-activated indexing device 208 from the production tubing 112. After a predetermined number of pressure cycles, the pressure-activated indexing device 208 moves in the uphole direction 402 a distance sufficient to allow the latch 210 to move in the downhole direction 130 into an unlatched position. While the ratchet system 500 is depicted as a body lock ring in FIG. 5, other latching devices that prevent movement of system components are also contemplated.

Figure 6:
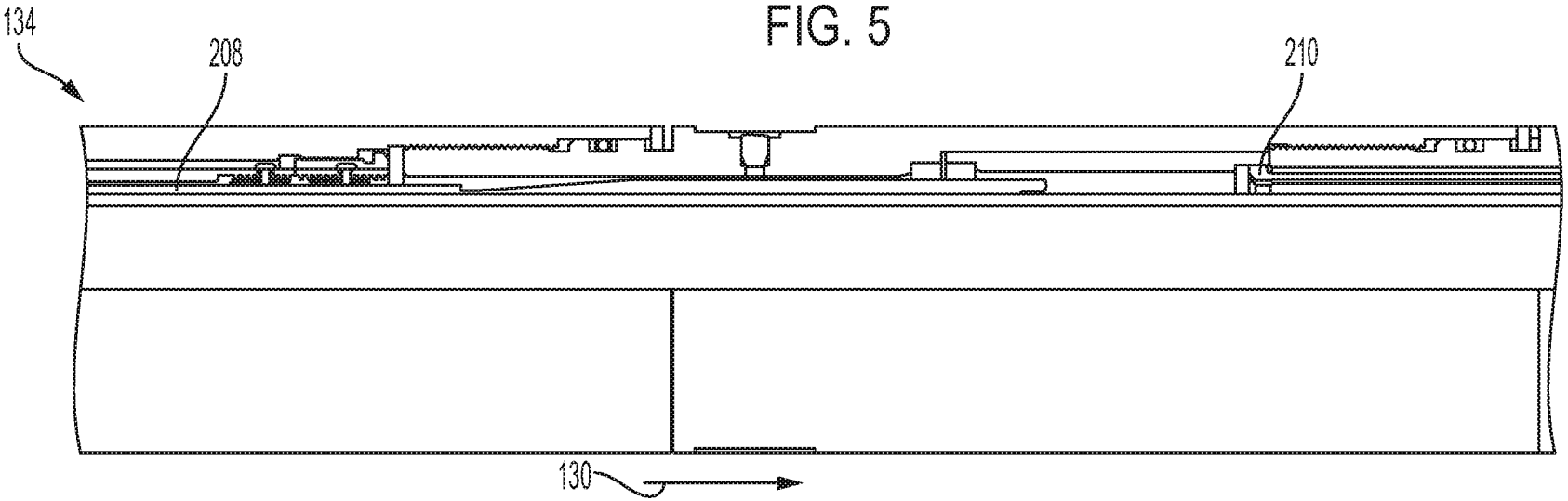
FIG. 6 is a sectional view of an example of the pressure-activated indexing device of the remote-open device of FIG. 1 in an open configuration according to some aspects of the present disclosure.

FIG. 6 is a sectional view of an example of the pressure-activated indexing device 208 of the remote-open device 134 in an open configuration according to some aspects of the present disclosure. As described in FIG. 5, the pressure-activated indexing device 208 moves a sufficient distance in the uphole direction 402 after a predetermined number of pressure cycles to allow movement of the latch 210 in the downhole direction 130. The latch 210 then moves in the downhole direction 130 to enable movement of the power spring 212 as shown in FIG. 2. The power spring 212 is then able to move the connection component 214 to move the sleeve 216 as described in FIGS. 3 and 4.

Figure 7:
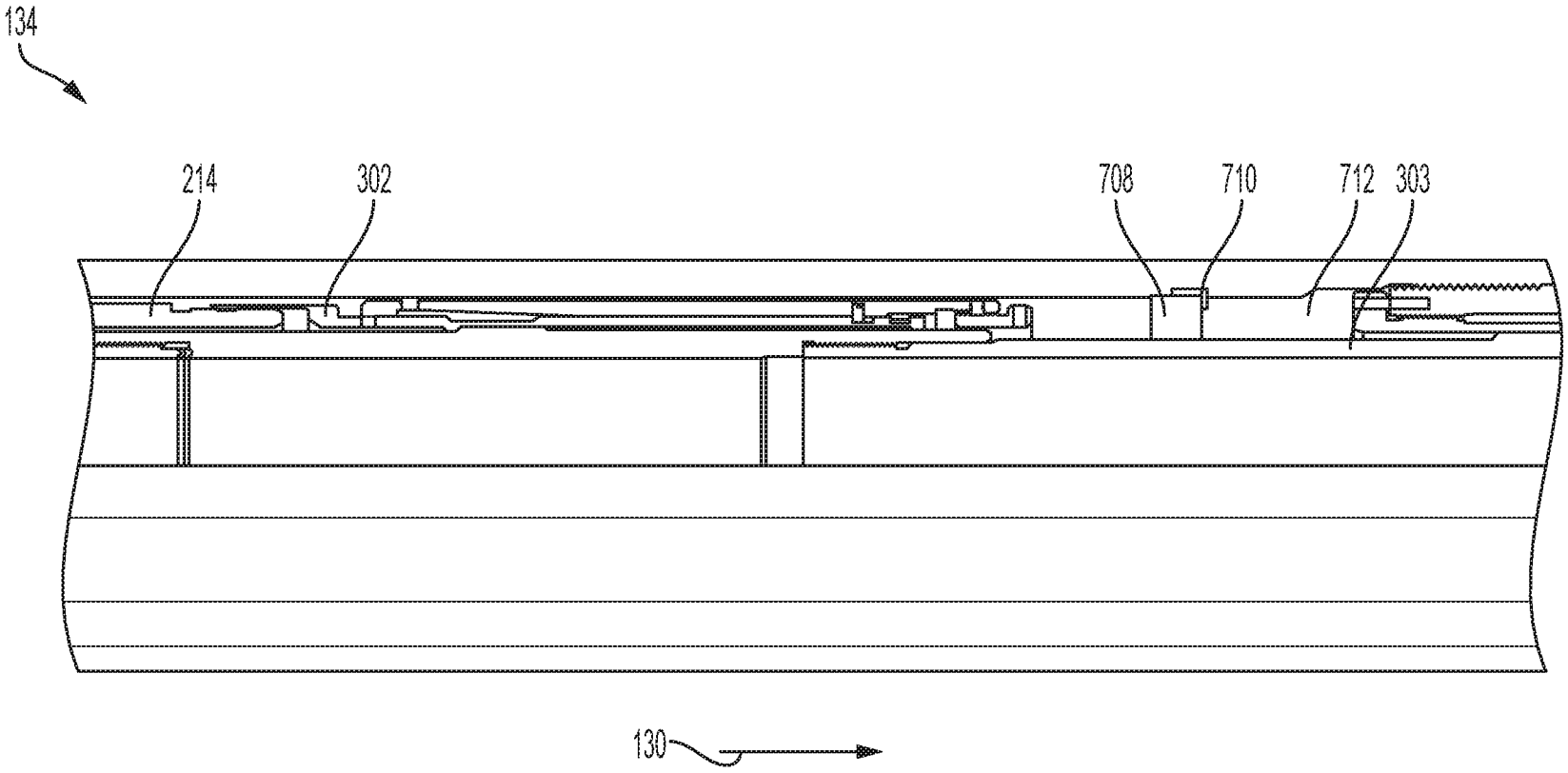
FIG. 7 is a sectional view of an example of a downhole section of the remote-open device of FIG. 1 in a closed configuration with an atmospheric chamber according to some aspects of the present disclosure.

FIG. 7 is a sectional view of an example of a downhole section of the remote-open device 134 in a closed configuration with an atmospheric chamber 712 according to some aspects of the present disclosure. The hydrostatic piston 708 is locked to a shoulder of a shear ring 710. This aspect can be implemented as an alternative to the examples described in FIGS. 3 and 4. For example, the atmospheric chamber 712 (e.g., a hydrostatically balanced chamber) can be used to generate hydrostatic force (e.g., pressure) such that the hydrostatic piston 708 can push the shoulder of the shear ring 710 in the downhole direction 130 to release the shear ring 710. Upon release of the shear ring 710, the atmospheric chamber 712 is acted on by the hydrostatic piston 708 for purposes of transitioning the device into a remote-open configuration by transferring the hydrostatic force from the atmospheric chamber 712 to the shoulder 303.

As described in FIGS. 2-6, pressure cycles can be applied to the pressure-activated indexing device 208. After the determined number of pressure cycles, the pressure-activated indexing device 208 can release the latch 210. Upon release of the latch 210, the power spring 212 is released. The power spring 212 then provides a spring force to the connection component 214. The connection component 214 provides the uncoupling force downhole to engage the uncoupling device 302 and a shear ring 710. The uncoupling device 302 allows movement of the sleeve 216. The connection component 214 engages the hydrostatic piston 708 such that the hydrostatic piston 708 provides a hydrostatic force on the shear ring 710, which holds the hydrostatic piston 708 in a locked position until a unlocking force reaches a shear threshold for the shear ring 710. When the shear ring 710 shears into an unlocked position, the hydrostatic piston 708 supplies the hydrostatic force to the atmospheric chamber 712 to generate a pressure within the atmospheric chamber 712 that supplies the hydrostatic force to the shoulder 303. In some examples, the hydrostatic piston 708 can be replaced with a rupture disk so that the hydrostatic force reaches the shoulder 303.

Figure 8:
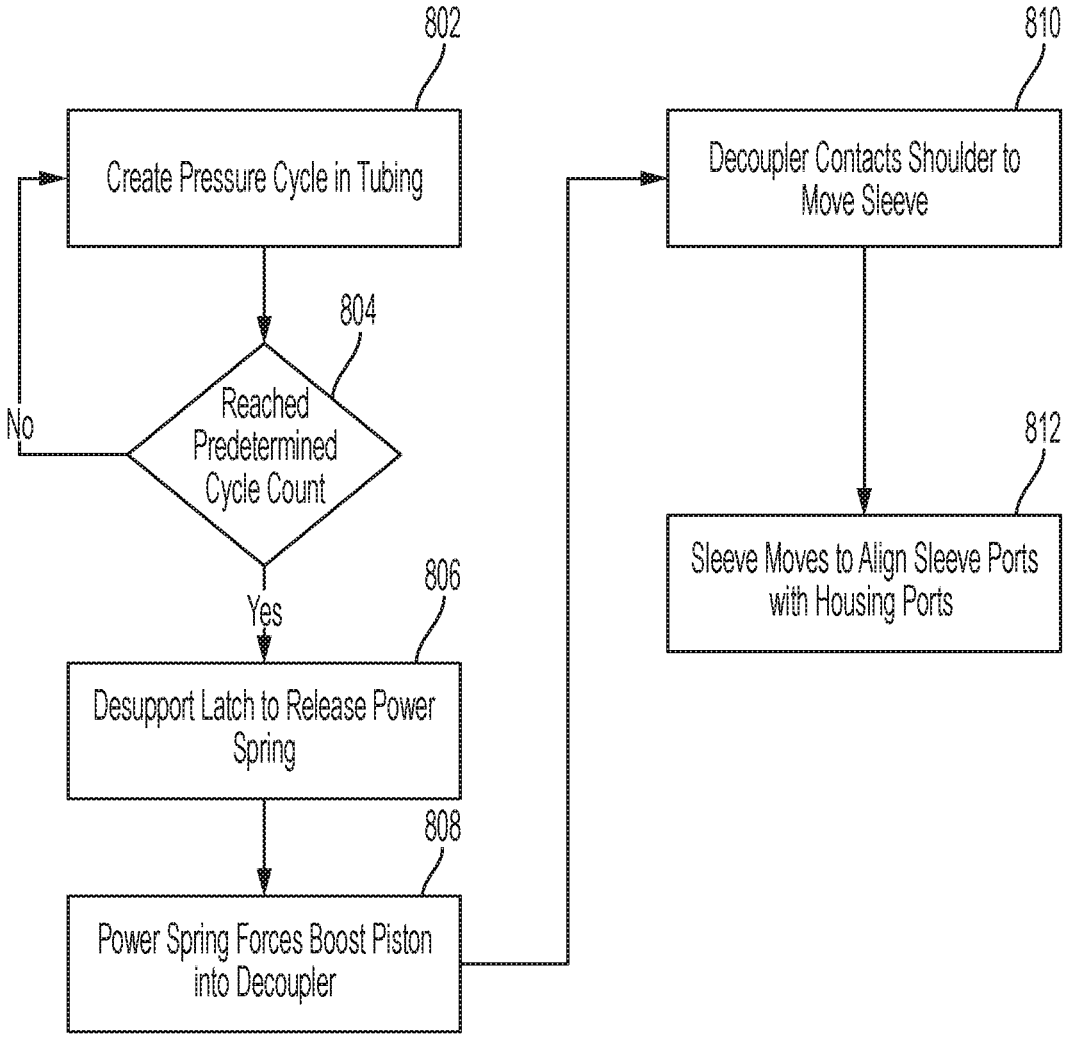
FIG. 8 is a flowchart of a process for operating the remote-open device of FIGS. 1-7 according to some aspects of the present disclosure.

FIG. 8 is a flowchart of a process 800 for operating the remote-open device 134 according to some aspects of the present disclosure. At block 802, the process 800 involves creating a pressure cycle in the production tubing 112. Once the pressure cycle is created, the floating piston 204 can be used to deliver pressure cycles to the pressure-activated indexing device 208. At block 804, the pressure-activated indexing device 208 moves according to the number of pressure cycles that have been applied. If the number of pressure cycles is less than a predetermined number of pressure cycles, no further action is taken until more pressure cycles are applied, as shown in block 802.

At block 806, after a predetermined number of pressure cycles, the process 800 involves the pressure-activated indexing device 208 de-supporting the latch 210 releasing the power spring 212. The movement is facilitated by the power spring 212 and connection component 214, which cause the sleeve 216 to move with respect to the housing 218.

At block 808, process 800 involves the power spring 212 applying a spring force to push the connection component 214 in the downhole direction 130 downward such that the connection component 214 engages the uncoupling device 302 to apply an uncoupling force. The uncoupling device 302 prevents the sleeve 216 from moving until the power spring 212 engages the connection component 214 such that the connection component 214 allows the sleeve 216 to move.

At block 810, the process 800 involves the uncoupling device 302 moving to contact the shoulder 303 to move the sleeve 216. The sleeve 216 becomes moveable when the uncoupling device 302 is engaged and uses the uncoupling force provided by the connection component 214 to move the sleeve 216 in the downhole direction 130.

At block 812, the process 800 involves the sleeve ports 126 aligning with the housing ports 128 as a result of the sleeve 216 moving in the downhole direction. Aligning the sleeve ports 126 with the housing ports 128 provides communication between the interior 304 of the remote-open device 134 and the fluid flow path 316. This places the remote-open device 134 in an open configuration.

Examples of the methods disclosed in the process in FIG. 8 may be performed in the operation of the downhole tool as shown in FIGS. 2-7. The order of the blocks presented in the process in FIG. 8 above can be varied—for example, blocks can be reordered, combined, removed, broken into sub-blocks, or any combination thereof. Certain blocks or processes can also be performed in parallel.

As used below, any reference to a series of examples is to be understood as a reference to each of those examples disjunctively (e.g., "Examples 1-4" is to be understood as "Examples 1, 2, 3, or 4").

Example 1 is an assembly comprising: a housing of a production tubing that comprises one or more housing ports around a housing circumference of the housing; a sleeve comprising one or more sleeve ports around a sleeve circumference of the sleeve, wherein the sleeve is moveable between (i) a closed configuration in which at least a portion of the sleeve is positionable to cover the housing ports of the production tubing and (ii) an open configuration in which the sleeve is positionable such that the sleeve ports provide fluid communication between the production tubing and an annulus in a wellbore; and a shoulder positioned at an uphole edge of the sleeve to apply an opening force to the sleeve to change the sleeve from the closed configuration to the open configuration.

Example 2 is the assembly of example 1, wherein the assembly further comprises: an uncoupling device; and a boost piston positionable to apply an uncoupling force to the uncoupling device, wherein the sleeve is stationary when the uncoupling device is disengaged and is movable when the uncoupling device is engaged, and wherein the uncoupling device is adapted to be engaged in response to the boost piston applying the uncoupling force to the uncoupling device.

Example 3 is the assembly of example 2, further comprising: one or more springs positionable to apply a spring force to the boost piston to cause the boost piston to apply additional uncoupling force to the uncoupling device.

Example 4 is the assembly of example 3, further comprising: a pressure-activated indexing device positioned to release one or more springs in response to receiving a predetermined number of pressure cycles.

Example 5 is the assembly of example 2, wherein a profile on the sleeve is further used to open and close the sleeve manually.

Example 6 is the assembly of examples 1-5, further comprising: a hydrostatic piston positionable to compress an atmospheric chamber to apply the opening force to the shoulder; and a shear ring having a locked position in which the hydrostatic piston is held in place and an unlocked position in which the hydrostatic piston is not held in place, wherein the shear ring is movable from the locked position to the unlocked position in response to an unlocking force being applied to the shear ring.

Example 7 is the assembly of examples 1-6, wherein the sleeve is positionable to change from the open configuration to the closed configuration in response to a decrease in the opening force applied to the shoulder.

Example 8 is a method comprising: receiving one or more pressure cycles at a production tubing in a wellbore; in response to receiving the one or more pressure cycles, moving a pressure-activated indexing device to release a latch and enable movement of a power spring; applying a spring force, by the movement of the power spring, to a connection component; in response to applying the spring force to the connection component, applying an uncoupling force to a shoulder of a sleeve; and in response to applying the uncoupling force to the shoulder, applying an opening force to the sleeve such that a first opening in the sleeve is aligned with a second opening in a housing of the production tubing to provide fluid communication between the production tubing and an annulus of the wellbore.

Example 9 is the method of example 8, wherein applying the uncoupling force to the shoulder of the sleeve further comprises applying the uncoupling force to an uncoupling device that is sheared when the uncoupling force is applied.

Example 10 is the method of example 9, wherein applying the opening force to the sleeve further comprises the uncoupling device moving to engage the shoulder.

Example 11 is the method of example 9, wherein a profile on the sleeve is used to open and close the sleeve manually.

Example 12 is the method of example 9 wherein, in response to reducing the uncoupling force applied to the uncoupling device, the sleeve moves such that the first opening in the sleeve is misaligned with the second opening in the housing to prevent fluid communication between an inner area of the production tubing and the annulus of the wellbore.

Example 13 is the method of examples 8-12, wherein applying the spring force to the connection component causes shearing of a shear ring to enable movement of a hydrostatic piston.

Example 14 is the method of example 13, wherein the hydrostatic piston operates on an atmospheric chamber to increase pressure and apply a hydrostatic force to the shoulder of the sleeve.

Example 15 is a system, comprising: a production tubing; and a remote-opening device positionable at a downhole end of the production tubing, the remote-opening device comprising: a housing comprising one or more housing ports around a housing circumference of the housing; a sleeve comprising one or more sleeve ports around a sleeve circumference of the sleeve positioned to restrict fluid communication between an inner area the production tubing and an annulus in a closed configuration and positioned to allow fluid communication between the inner area of the production tubing and the annulus in an open configuration; and a shoulder positioned at an uphole edge of the sleeve to apply an opening force to the sleeve to change the sleeve from the closed configuration to the open configuration.

Example 16 is the system of example 15, wherein the remote-opening device further comprises: a boost piston that is positioned to apply an uncoupling force to the sleeve; a power spring that is positioned to apply a spring force to the boost piston; and an uncoupling device that is adapted to be engaged in response to the boost piston applying the uncoupling force to the uncoupling device, and wherein the sleeve is stationary when the uncoupling device is disengaged and is movable when the uncoupling device is engaged.

Example 17 is the system of example 16, wherein the remote-opening device further comprises: a latch, wherein the power spring is stationary when the latch is latched and is movable when the latch is unlatched; and a pressure-activated indexing device positioned to unlatch the latch in response to receiving a predetermined number of pressure cycles.

Example 18 is the system of example 16, wherein the housing defines an atmospheric chamber for containing a fluid to apply the opening force to the shoulder when compressed, wherein the remote-opening device further comprises: a hydrostatic piston positionable to compress the fluid in the atmospheric chamber; and a shear ring positioned to shear in response to the uncoupling force, and wherein the hydrostatic piston is movable when the shear ring has sheared.

Example 19 is the system of example 16, wherein a profile of the sleeve is further useable to open and close the sleeve manually.

Example 20 is the system of examples 15-19, wherein the sleeve is further positionable to change from the open configuration to the closed configuration in response to a decrease in the opening force applied to the shoulder.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

The invention claimed is:

1. An assembly comprising:

a housing of a production tubing that comprises one or more housing ports around a housing circumference of the housing;

a sleeve comprising one or more sleeve ports around a sleeve circumference of the sleeve, wherein the sleeve is moveable between (i) a closed configuration in which at least a portion of the sleeve is positionable to cover the housing ports of the production tubing and (ii) an open configuration in which the sleeve is positionable such that the sleeve ports provide fluid communication between the production tubing and an annulus in a wellbore;

a shoulder positioned at an uphole edge of the sleeve to apply an opening force to the sleeve to change the sleeve from the closed configuration to the open configuration;

a power spring that is configured to apply a spring force for moving the sleeve to the open configuration;

a latch that is separated from the shoulder by at least the power spring, wherein the power spring is stationary when the latch is latched and is movable when the latch is unlatched; and an uncoupling device positioned between the power spring and the shoulder, wherein the sleeve is stationary when the spring force from the power spring is not applied to the uncoupling device and movable when the spring force is applied to the uncoupling device.

2. The assembly of claim 1, wherein the assembly further comprises:

a boost piston positionable to apply an uncoupling force to the uncoupling device, wherein the sleeve is stationary when the uncoupling device is disengaged and is movable when the uncoupling device is engaged, and wherein the uncoupling device is adapted to be engaged in response to the boost piston applying the uncoupling force to the uncoupling device.

3. The assembly of claim 2, wherein the power spring is positionable to apply the spring force to the boost piston to cause the boost piston to apply additional uncoupling force to the uncoupling device.

4. The assembly of claim 3, further comprising:

a pressure-activated indexing device positioned to release one or more springs in response to receiving a predetermined number of pressure cycles.

5. The assembly of claim 2, wherein a profile on the sleeve is further used to open and close the sleeve manually.

6. The assembly of claim 1, wherein the sleeve is positionable to change from the open configuration to the closed configuration in response to a decrease in the opening force applied to the shoulder.

7. The assembly of claim 1, wherein the latch does not contact the shoulder when the sleeve is in the open configuration.

8. The assembly of claim 1, wherein the power spring is positioned between the latch and the shoulder.

9. The assembly of claim 1, wherein the sleeve is stationary when the uncoupling device is disengaged from the power spring and is movable when the uncoupling device is engaged using the power spring.

10. A system, comprising:

a production tubing; and a remote-opening device positionable at a downhole end of the production tubing, the remote-opening device comprising:

a housing comprising one or more housing ports around a housing circumference of the housing;

a sleeve comprising one or more sleeve ports around a sleeve circumference of the sleeve positioned to restrict fluid communication between an inner area of the production tubing and an annulus in a closed configuration and positioned to allow fluid communication between the inner area of the production tubing and the annulus in an open configuration;

a shoulder positioned at an uphole edge of the sleeve to apply an opening force to the sleeve to change the sleeve from the closed configuration to the open configuration;

a power spring that is configured to apply a spring force for moving the sleeve to the open configuration;

a latch that is separated from the shoulder by at least the power spring, wherein the power spring is stationary when the latch is latched and is movable when the latch is unlatched; and an uncoupling device positioned between the power spring and the shoulder, wherein the sleeve is stationary when the spring force from the power spring is not applied to the uncoupling device and movable when the spring force is applied to the uncoupling device.

11. The system of claim 10, wherein the remote-opening device further comprises:

a boost piston that is positioned to apply an uncoupling force to the sleeve; and the power spring positioned to apply the spring force to the boost piston;

wherein the uncoupling device is adapted to be engaged in response to the boost piston applying the uncoupling force to the uncoupling device, and wherein the sleeve is stationary when the uncoupling device is disengaged and is movable when the uncoupling device is engaged.

12. The system of claim 11, wherein the remote-opening device further comprises:

a pressure-activated indexing device positioned to unlatch the latch in response to receiving a predetermined number of pressure cycles.

13. The system of claim 11, wherein a profile of the sleeve is further useable to open and close the sleeve manually.

14. The system of claim 10, wherein the sleeve is further positionable to change from the open configuration to the closed configuration in response to a decrease in the opening force applied to the shoulder.

15. The system of claim 10, wherein the latch does not contact the shoulder when the sleeve is in the open configuration.

16. The system of claim 10, wherein the power spring is positioned between the latch and the shoulder.

17. The system of claim 10, wherein the sleeve is stationary when the uncoupling device is disengaged from the power spring and is movable when the uncoupling device is engaged using the power spring.

* * * * *